US006659296B2

(12) United States Patent
Browne

(10) Patent No.: US 6,659,296 B2
(45) **Date of Patent: *Dec. 9, 2003**

(54) CAP FOR CONTAINER

(75) Inventor: Martin Monteagle Browne, Oslo (NO)

(73) Assignee: Amersham Health AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/767,320

(22) Filed: Jan. 23, 2001

(65) Prior Publication Data

US 2001/0009243 A1 Jul. 26, 2001

Related U.S. Application Data

(60) Provisional application No. 60/187,558, filed on Mar. 7, 2000.

(30) Foreign Application Priority Data

Jan. 26, 2000 (GB) ..... 0001840

(51) Int. Cl.[7] ..... B65D 51/20
(52) U.S. Cl. ..... 215/249; 215/251; 215/254
(58) Field of Search ..... 215/249, 251, 215/247, 264, 274, 276, 277; 604/403, 415

(56) References Cited

U.S. PATENT DOCUMENTS 3,499,568 A * 3/1970 Riera ..... 215/247
3,888,377 A * 6/1975 Stadler ..... 215/249
4,678,753 A * 7/1987 Hempel et al. ..... 215/277
5,316,163 A * 5/1994 von Schuckmann ..... 215/249
5,379,908 A * 1/1995 Rohe ..... 215/249
5,957,314 A * 9/1999 Nishida et al. ..... 215/249
6,223,918 B1 * 5/2001 Browne ..... 215/249

FOREIGN PATENT DOCUMENTS

| | | |
|---|---|---|
| DE | 19500460 A1 | 7/1996 |
| EP | 0079676 B1 | 12/1986 |
| EP | 0480196 A1 | 4/1992 |
| EP | 0794129 A1 | 9/1997 |
| FR | 2745793 | 12/1997 |

* cited by examiner

*Primary Examiner*—Nathan J. Newhouse
(74) *Attorney, Agent, or Firm*—Robert F. Chisholm

(57) ABSTRACT

A package (10) comprises a plastic bottle (20), a stopper (40) removably inserted into the mouth of the bottle, and a plastic cap (50). The cap has a cover member (52) which overlies the stopper and has a region (66) which is removable to expose the upper surface of the stopper to allow piercing thereof by a needle or the like. The removable region is provided with a pull-ring (68) protected from accidental operation by a protective portion (60) projecting upwardly from the edge of the cover member (52). The protective portion is formed separately from the rest of the cap and is attached thereto.

8 Claims, 4 Drawing Sheets

CAP FOR CONTAINER

The present application claims foreign priority benefits under 35 U.S.C. §119 to Great Britain patent application serial No. 0001840.8 filed on Jan. 26, 2000. The present application further claims the benefit under 35 U.S.C. §119 (e) to U.S. provisional patent application serial No. 60/187,588 filed on Mar. 7, 2000.

BACKGROUND OF INVENTION

In the medical field, sterile fluids, such as medicaments, pharmaceuticals, sterile saline solution and so on are frequently required for the treatment of patients.

Such sterile fluids are commonly supplied in bottles made of glass, which are chemically inert and highly unlikely to contaminate or otherwise adulterate the sterile fluid.

The bottles are normally closed by a rubber stopper inserted into the mouth of the bottle. The stopper is designed so that it can be pierced by a needle of a hypodermic syringe, an infusion spike of an infusion set, a spike of an autoinjector, or the like, to allow the contents of the bottle to be withdrawn. The stopper can also be removed to allow the contents of the bottle to be poured out, or to be sucked up using a quill or straw of an autoinjector.

In order to hold the stopper in place, one approach has been to provide a cap made of aluminium or similar thin sheet metal which is crimped over the stopper and the upper part of the bottle. In order to gain access to the stopper, either to pierce it or remove it, the sheet metal cap is either partially or totally torn away.

However, packages incorporating aluminium caps have a number of disadvantages. For example, tearing the aluminium cap away can cause problems, as sharp edges are left where the cap is torn. These edges are sharp enough to puncture surgical gloves and human skin, which is obviously a disadvantage in the medical field in particular, where the risk of infection must be kept to a minimum.

In addition, in many countries, waste must be sorted by nature or type before being disposed of. Having a metal cap and a rubber stopper on a glass bottle means that the package contains three different sorts of material (glass, metal and plastics), which must be disposed of separately.

Alternative approaches to containers for sterile fluids have also been tried, with varying degrees of success. In one known product, plastic bottles with screw caps are used, the screw caps having stoppers attached thereto. When the screw cap is removed, the stopper is also removed from the bottle. However, the package is not compatible with infusion procedures, and cannot be used with hypodermic needles as the standard packages can.

In another proposal, described in DE 19500460, a plastic bottle is provided with an injection moulded cap which is covered by a plastic foil. In this proposal there is no stopper in the mouth of the bottle and the primary sealing of the bottle is by an integrally moulded closure wall which is pierceable by a cannula or spike but not otherwise openable. The cap fits over the closure wall. When it is desired to access the contents of the bottle the foil is removed and both the cap and the closure wall must be pierced, requiring sufficient force to penetrate both these parts and with a possible risk of the cannula or spike being plugged by the material of the closure wall, or coring that material to create particles in the contents of the bottle.

Further types of closures, manufactured by Stelmi of France, are marketed under the name of "Monobloc"™ and "Duobloc"™. Corresponding patent publications are FR 2745793 and EP 0794129. The "Monobloc" comprises a plastics cap which fits over the neck and stopper of a traditional glass bottle. A removable portion may be torn away to allow access to the stopper, and the entire cap can be removed if necessary. The "Duobloc" is similar, but has a screw-threaded insert which snaps over the neck of the glass bottle, and the remainder of the cap is threadedly engaged with the insert.

In the case of such plastics caps, the removable portion is integrally moulded with the rest of the cap. A line of weakness is normally provided around the removable portion to allow the removable portion to be torn away to gain access to the stopper. The stopper can then be pierced by a needle or infusion spike or the like. An engageable member in the form of a pull-ring is integrally moulded with the removable portion and when it is desired to gain access to the top surface of the stopper a force is applied to the pull-ring to remove the removable portion.

There is however a disadvantage of such plastics caps provided with pull-rings. In order for the pull-rings provided on the caps to be accessible they generally project from the cap. However, during shipping and storage, there is a risk that the pull-rings will snag on something and accidentally be operated to cause the line of weakness to be torn. This may result in the complete removal of the removable portion and thus result in the scrapping of the package and its contents. Alternatively, the tear may only be very small and, although not sufficient to cause the removable portion to be removed, allow contamination of the stopper. Such accidental partial opening of the cap may only be detected upon close inspection of the cap. In certain cases adequate inspection of the integrity of the cap seal may not be performed before it is opened and, consequently, the package may be used when in fact the top surface of stopper has become contaminated. This is clearly undesirable.

A proposed solution to the problem of accidental opening of packages incorporating a cap with a removable portion has been to surround the pull-ring with a raised section in the form of an annular wall. In such a proposal, shown in FIG. 7 of EP 0480196, a two piece injection moulded cap is provided, to be welded to a plastics bottle. In this proposal a first moulding defines the portion of the cap to be attached to the bottle and a hole is formed in the upper surface thereof for receiving a cannula. The hole may be covered by a membrane. An annular wall is formed which extends about the periphery of the upper surface. A second moulding is made up of a ring, which fits inside the annular wall of the first moulding, and a pull-ring attached to a removable portion which in turn is attached to the ring by a circumferential weakened region. The two mouldings are formed separately and then ultrasonically welded to form a sealing bond between the upper surface of the first moulding and the ring of the second moulding. The cap is then permanently attached to the plastic bottle. When it is desired to gain access to the contents of the bottle the pull-ring is removed by tearing along the weakened region and a cannula may be introduced into the bottle through the hole formed in the first moulding.

However, with such a cap the sterility of the upper surface of the first moulding is dependent on the quality of the ultrasound weld, so that any defect in the weld will create the potential for contamination of the upper surface.

Another proposal for a cap having a protective annular wall for a pull-ring for removing a removable portion is described in EP 0079676. This cap is for a plastic bottle and is made up of a plug member and three plastic injection mouldings. The first moulding consists of the pull-ring, the removable portion connected to the rest of the moulding by a frangible region, and an annular wall which extends around the pull-ring. The plug member is positioned in a cavity, formed by a portion of the annular wall projecting below the removable portion, and sealed in place by the second moulding which is formed around the lower part of the first moulding. The cap is completed by a third moulding which is formed around the external surfaces of the first and second mouldings. The cap is then heat-welded along its lower edge to the neck of a plastic bottle. In order to gain access to the contents of the bottle the removable portion is removed by pulling on the pull-ring and causing the weakened region to tear. A syringe, cannula or other such device may then be introduced through the plug member and a wall of the second moulding.

The arrangement of EP 0079676 avoids the problem mentioned above concerning EP 0480196, of relying on a single ultrasonic weld to maintain the sterility of a region to be pierced after tearing away the removable portion. It is however a relatively complicated arrangement in that it consists of four separate components: three mouldings and the plug member.

Moreover, there is no teaching in EP 0079676 of how the first moulding is actually made. It is however assumed, based on the shape of the moulding as seen in FIGS. 2 to 4 of the document, that the first moulding would be injection moulded using axially movable mould tools. A lower tool would be employed to define the cavity for the plug member, a first upper tool of generally cylindrical shape to define the space inside the pull-ring, and a second upper tool of generally tubular shape to define the space radially outwardly of the pull-ring and radially inwardly of the annular wall and also the space below the pull-ring. The pull-ring has a chamfered radially outer surface, so that it is assumed that after injection moulding has taken place the first upper tool is withdrawn axially upwardly, followed by axial upward withdrawal of the second upper tool. During this latter withdrawal, the chamfered surface on the pull-ring should allow it to be pushed radially inwardly by a camming action of the second upper tool. This would enable the pull-ring to be moulded with an integral connection at one region around its circumference to the wall of the moulding below, but otherwise at an upward spacing from the wall.

Attempts to injection mould a plastics cap having a pull-ring, a removable portion, and an annular wall using the method described above have been made. The inventor of the present invention has discovered that it is extremely difficult to use the method without a high failure rate. The pull-ring tends to be pulled up with the second upper tool, leading to the pull-ring being torn apart and/or the frangible region being weakened, with a risk of compromising the sterility of the area below the frangible region. These problems are particularly acute when the material used is polypropylene, which is unfortunate, because polypropylene is a preferred material for forming injection mouldings and, in particular, plastic caps.

SUMMARY OF INVENTION

Viewed from a first aspect the invention provides a cap for a container, comprising:

a moulding, the moulding comprising a retaining portion for engaging the container and retaining the cap thereon, a frangibly removable portion which is removable to expose at least partly a closure member for the container, and a user engageable member operable by a user to remove the removable portion; and a protective portion for the engageable member and provided radially outwardly thereof, the protective portion being formed separately of the moulding and being attached thereto.

By forming the moulding and the protective portion separately, the problems of damaging the engageable member or the removable portion when separating the moulding from its mould may be avoided. Rather than using axially movable mould members as described above, the absence of the protective portion during moulding allows radially movable mould members to be used, because they are unobstructed by the protective portion. Such radially movable mould members, and associated injection moulding techniques, are known to persons skilled in the art.

The invention can thus provide a relatively simple cap construction with a removable portion for covering a closure member, with a high level of confidence that the closure member is protected from contamination by the removable portion up until the time when it is desired to remove the removable portion.

Although the closure member may be part of the cap, for example being in the form of a pierceable wall of the cap, the closure member preferably comprises a stopper provided in the mouth of the container.

Viewed from a second aspect, the invention provides a package comprising a container with a mouth, a stopper removably inserted into said mouth, a cap overlying said stopper, wherein the cap comprises a moulding provided with a frangibly removable portion which is removable to expose at least partly the stopper and with a user engageable member operable by a user to remove the removable portion, and wherein the cap further comprises a protective portion for the engageable member and provided radially outwardly thereof, the protective portion being formed separately of the moulding and being attached thereto.

The cap and protective portion will generally be formed of a plastic material and are preferably formed from polypropylene or polyethylene. Although the cap and protective portion are generally formed from the same material they may alternatively each be formed from a different material.

Preferably, the protective portion is removably attached to the rest of the cap by an appropriate mechanical means, such as a screw fit. Upon removal of the protective portion the container may advantageously be used in existing autoinjector and pump equipment without modifying the equipment. This thus avoids the disadvantage of known caps, formed with an integral annular wall, that the container cannot readily be used in standard autoinjector equipment as the annular wall tends to prevent the proper engagement of the cap with the autoinjector.

Preferably, the container and the cap have complementary threads to allow the cap to be removably attached to the container. In arrangements, in which the protective portion is also attached to the rest of the cap by complementary threads, the threads for attaching the protective portion are preferably reversed relative to those used for attaching the cap to the container. In this arrangement unscrewing of the protective portion does not cause the cap to be unscrewed, and vice versa. This has the further benefit of allowing the protective portion to be used to aid the removal of the cap, for example by insertion of a lever or the like.

Alternatively, the protective portion may be attached to the rest of the cap by other mechanical means, such as a snap fit. Typically, this may be by the formation of complementary projections, or complementary projections and indentations, on the protective portion and on the moulding. These will normally engage to prevent relative axial movement of the moulding and the protective portion. Equally, the moulding and the protective portion could be bonded, e.g. by ultrasonic welding, together. It is generally unnecessary to form a hermetically sealed join line between the protective portion and the moulding, because the join line may advantageously be located such that any break or interruption therein does not provide a pathway to the covered closure member, e.g. stopper.

In preferred arrangements the engageable member comprises a pull-ring upwardly spaced from the removable portion. This allows the user of the package to hook a finger beneath the engageable member, and thus makes it easier to operate.

Preferably, the protective portion of the cap comprises a wall which extends generally about the periphery of the engageable member to protect it from accidental operation or entanglement, e.g. with other packages. As a result, the engageable member is "shrouded", and there is less chance that the member can be accidentally operated. If the engageable member is a pull-ring, it is advantageous for such a pull-ring to be protected around its circumference.

It is further preferred that the wall has at least one opening therethrough. Most packages of sterile fluid for medical use are sterilized by autoclaving in either a steam atmosphere or in a water cascade. In steam autoclaves the steam can condense into water on the package as the atmosphere in the autoclave cools. Similarly, for water cascade autoclaves water may collect on the package once the sterilisation process is complete. If the wall is unbroken, then it can form a cup in which the water used for sterilisation collects. Providing an opening in the wall allows the water to escape.

In a preferred embodiment, a said opening is sufficiently large to allow radial access by a user's finger to the engageable member. Thus, protection of the engageable member can be provided without unduly hindering deliberate removal of the removable portion when desired. Preferably, the opening allowing such radial access is located opposite to a portion (such as a leg or pair of legs) of the moulding which connects the engageable member and the removable portion. This can assist a user to access the part of the engageable member furthest from the connecting portion and therefore most readily liftable away from the removable portion. This will be easily understood in the context of the engageable member being a pull-ring.

In order to be sure during assembly of the cap that the protective portion is correctly positioned relative to the moulding, for example to correctly position a radial opening relative to the engageable member, a mechanical interlock between the protective portion and the moulding may be appropriately designed, for example to allow only one or two relative positions.

The removable portion may have an inclined surface to assist drainage thereof when the cap is in an upright position. Drainage may then for example take place towards an opening in the protective portion. Preferably, the removable portion is upwardly convex.

In a preferred embodiment, the protective portion is in the form of a removable cover over the engageable member. Such a cover can prevent inadvertent operation of the engageable member, whilst being removable when it is desired to gain access to the engageable member.

Preferably, the cap is provided with a member which engages with the stopper when the package is closed to protect a defined region of the closure member, e.g. stopper, from contamination. The member is advantageously an annular member which extends downwardly from the cap and engages with the upper surface of the closure member. The annular member then provides a physical barrier to contaminants and helps keep the defined region sterile. The integrity of a seal created by the member is preferably achieved by the member resiliently deforming the part of the closure member against which it engages.

In one preferred embodiment, the container is a bottle.

The retaining portion of the moulding may provide a snap fit on the container or may take some other form. Preferably, the container and the cap have complementary screw threads. This provides a simple and effective way of securing the cap on the container.

It is preferred that the cap be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member removably attached to the cap, which must be detached from the cap before the cap can be removed. The absence of the member is then a sign that the package has been opened at some time, and should not be used.

A container provided with a stopper and a cap as defined herein can be opened in a number of ways. The removable portion can be removed to gain access to the stopper, whilst leaving the stopper in place. The stopper can then be pierced by a hypodermic needle, or similar. If the protective portion and the removable portion are both removed, the container may normally be used in conjunction with a standard autoinjector. Alternatively, the entire cap can be removed (which may entail removal of a tamper-evident feature), which then allows access to the entire stopper. This may be useful if, for example, an infusion spike or quill or straw which is wider than the removable portion is to be used. As a further alternative, the entire cap and the stopper can be removed, to enable pouring or the insertion of a quill or straw to load an autoinjector.

The cap may comprise at least one projection which acts as a pivot for the engageable member. If a pivot is not used, then the force exerted on the engageable member by the user is simply transmitted to the removable portion. However, if a pivot point is provided, then a leverage effect can allow the force exerted on the engageable member to be amplified, thus making it easier to remove the removable portion.

DETAILED DESCRIPTION OF INVENTION

Figure 1:
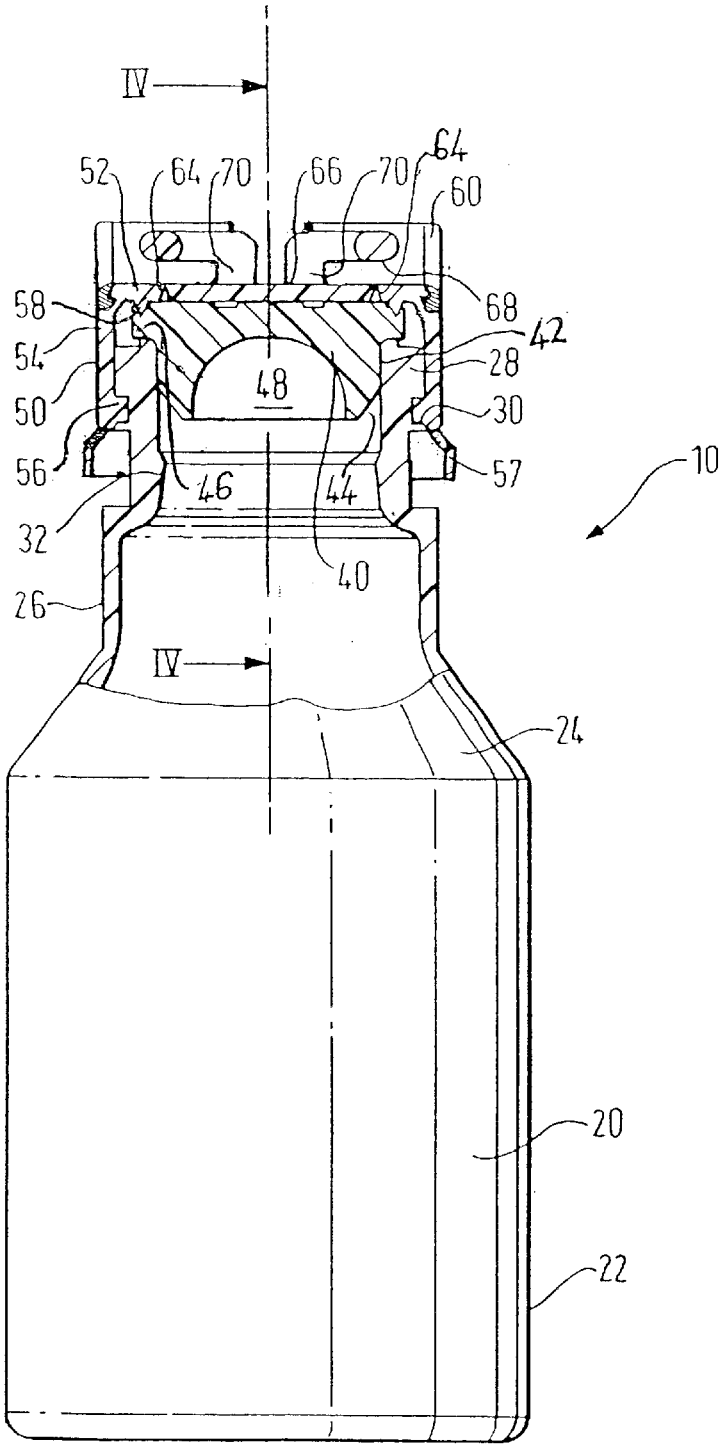
FIG. 1 is a side view, partially broken away, of a package according to a first embodiment of the invention.

FIG. 1 shows a package 10 according to a first embodiment of the invention. The package 10 comprises a plastics bottle 20, a stopper 40 and a plastics closure cap 50. The stopper is preferably formed from a thermoplastic polymer material, but may be formed from other synthetic polymer materials or synthetic rubber (e.g. chlorobutyl rubber) or natural rubber.

The bottle 20 has a body 22, a shoulder portion 24, and a narrowed neck portion 26 extending from the shoulder portion. The outer surface of the neck has an external screw thread 28 formed thereon. A lip 30 projects radially outwardly from the neck 26 below the external screw thread 28.

Figure 9:
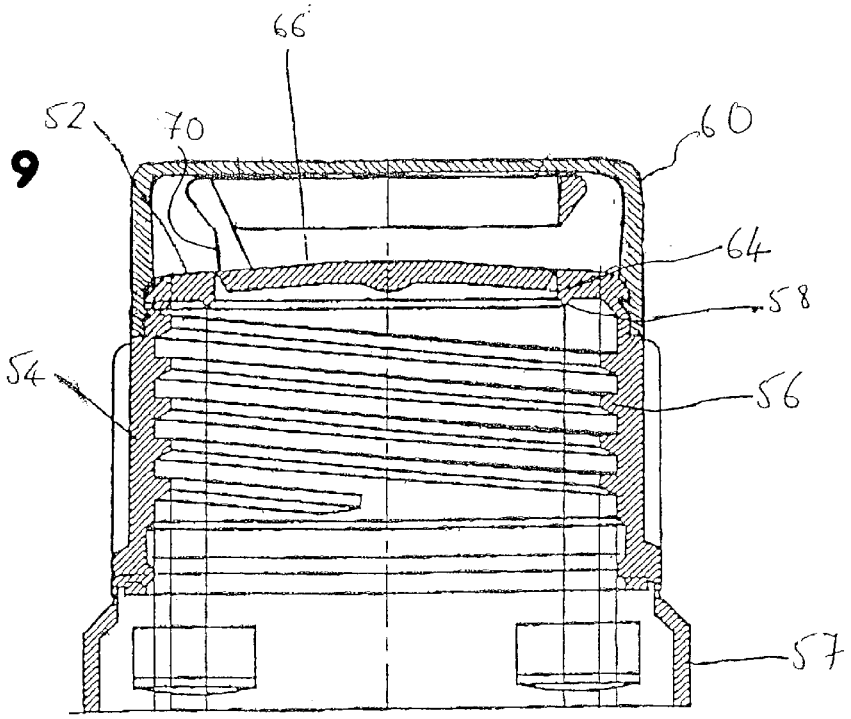
FIG. 9 is a cross-sectional view of the protective portion attached to the moulding according to the second embodiment.

The inner surface of the neck is substantially cylindrical. However, the inner surface also has a portion 32 of reduced diameter. The purpose of this portion is to prevent the stopper 40 from being pushed into the neck 26 when a force is applied to the stopper, for example by a hypodermic needle or the like. The portion can have a diameter only slightly less than that of the remainder of the neck, as shown in FIG. 1, or the diameter can be substantially less, as shown in FIGS. 9 and 10.

The stopper 40 has a generally cylindrical body 42, and the radius of the body is slightly greater than the radius of the inner surface of the neck of the bottle. This allows the body 42 of the stopper 40 to be an interference fit in the neck 26 of the bottle. The stopper thus seals the bottle. The lower end of the body 42 has a chamfer 44, to aid insertion of the body 42 into the neck 26 of the bottle 20.

At the upper end of the body 42 is a flange 46. The flange 46 rests on the top of the neck of the bottle when the stopper 40 is fully inserted thereinto.

In addition, the lower surface of the stopper 40 is formed with a hollow 48 therein. The hollow 48 extends upwardly from the lower surface towards the top of the stopper 42, and as a result the thickness of the central portion of the stopper 42 is considerably less than the length of the stopper. This makes it easier for the stopper to be pierced by a hypodermic needle, an infusion spike or the like.

The closure cap 50 is attached to the upper part of the neck 26 of the bottle. The cap has a cover member 52 which overlies the stopper 40, and an annular skirt 54 extending downwardly from the edge of the cover member 52.

Figure 3:
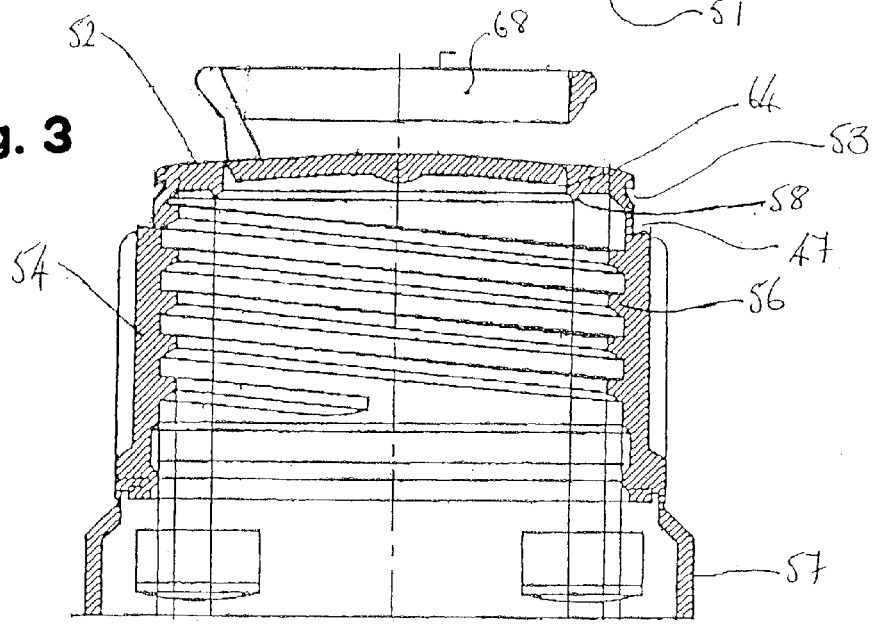
FIG. 3 is a cross-sectional view, also along line IV—IV OF FIG. 1, but showing the moulding of the cap only.

The skirt 54 has an internal screw thread 56 formed on its inner surface, and the internal screw thread 56 engages with the external screw thread 28 formed on the neck 26 of the bottle to retain the closure in place. The diameter of the skirt 54 is reduced at its upper end to form an external shoulder 47. A pair of radially inward indentations 53 are formed in the outer surface of the shoulder 47, as shown in FIG. 3. Detachably attached to the lower end of the skirt 54 is a ring 57. The ring 57 engages beneath the lip 30 on the neck 26 of the bottle. The detachable ring 57 thus serves as a tamper-evidencing element. In order to remove the cap 50 from the bottle 20, it is first necessary to detach the ring 57 from the cap 50, and the detached ring makes it clear to the user that the package 10 has been opened.

The underside of the cover member 52 has an annular member 58 extending downwardly from it. The lower end of the annular member engages with the upper surface of the stopper 40 and helps to ensure the integrity of the package 10. In addition, the annular member 58 surrounds a central region of the upper surface of the stopper, and helps to prevent contamination of it. The central region of the upper surface of the stopper is the part which is contacted by a needle or the like when the stopper is punctured, and provision of the annular member 58 helps to safeguard the overall sterility of the package.

Figure 2:
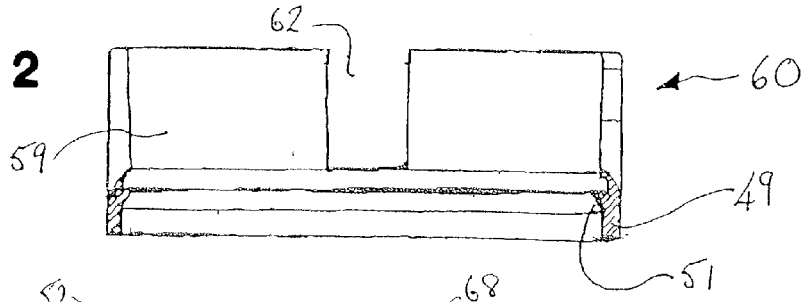
FIG. 2 is a cross-sectional view, along line IV—IV of FIG. 1, but showing the protective portion only.
Figure 4:
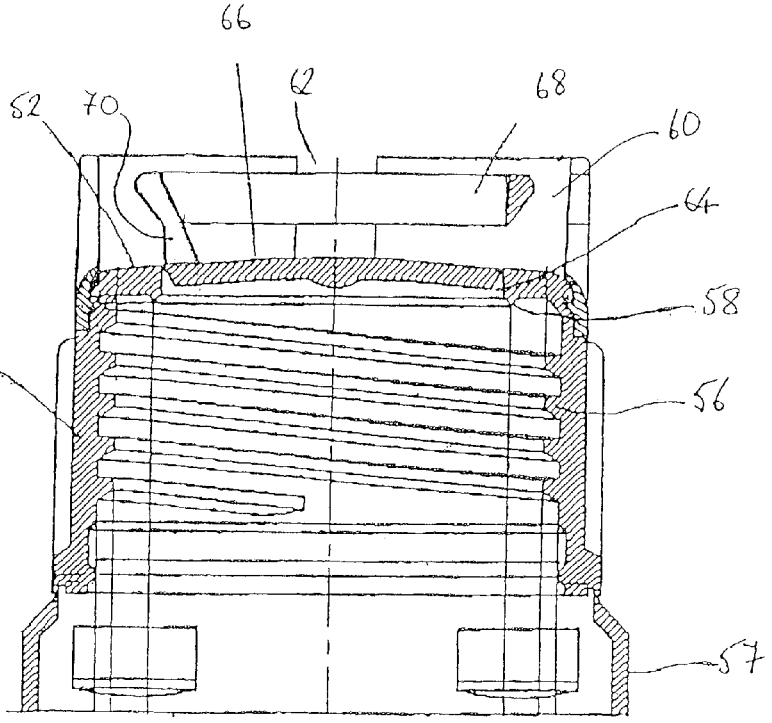
FIG. 4 is a cross-sectional view, also along line IV—IV, showing the protective portion attached to the moulding.
Figure 6:
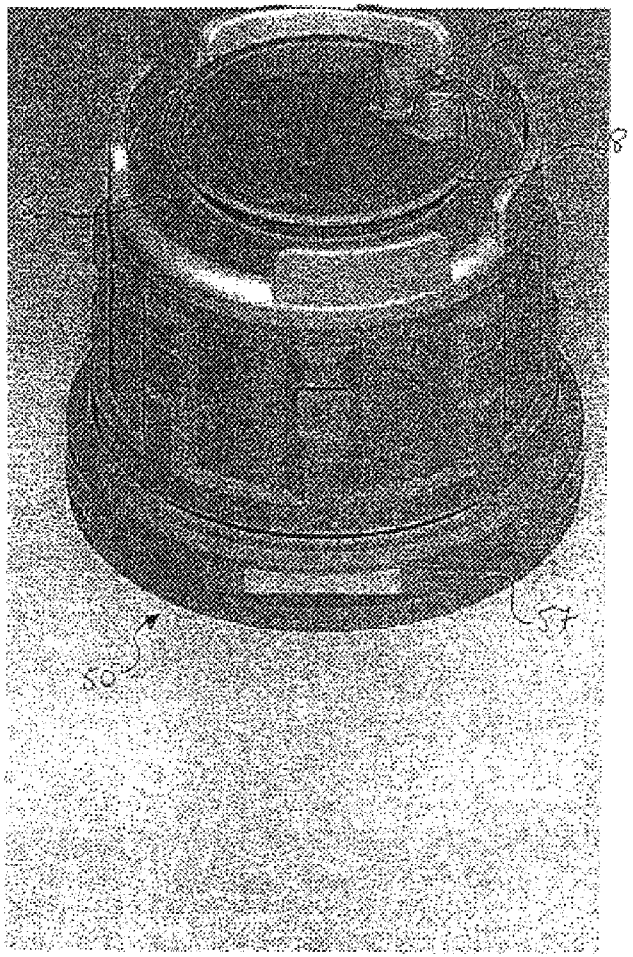
FIG. 6 is a perspective view of the cap of FIG. 1 after the protective portion has been attached.
Figure 5:
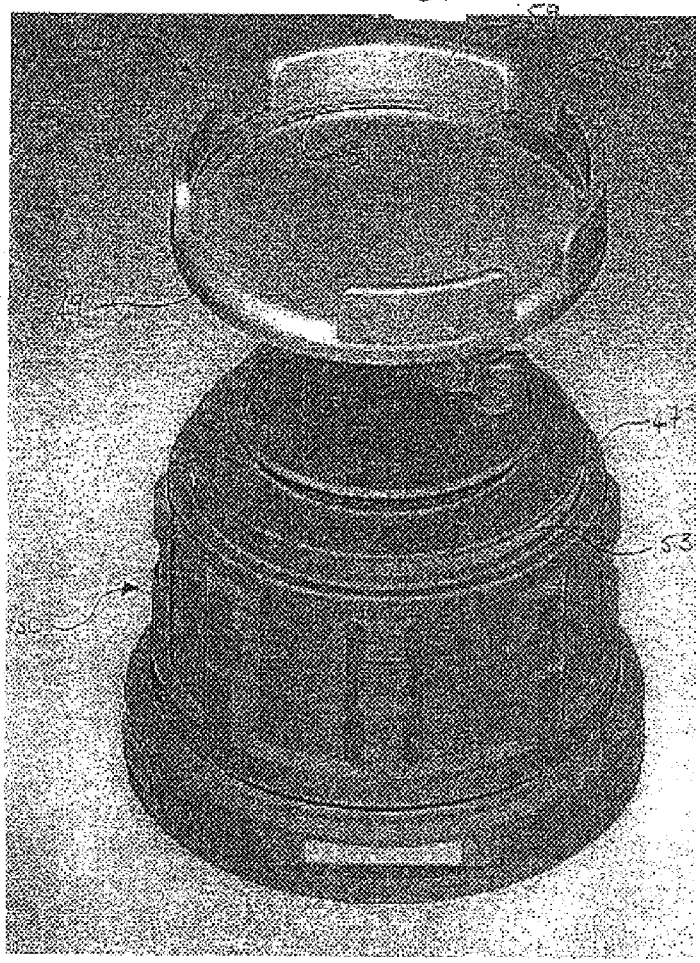
FIG. 5 is a perspective view of the cap of FIG. 1 before the protective portion is attached to the moulding.

A protective portion 60 of the cap, as shown in FIGS. 2 and 5, is formed separately from the rest of the cap 50 and is attached to the shoulder 47. The protective portion 60 is formed as a single piece and comprises a continuous ring member 49 with a series of upwardly projecting castellations 59; in the present embodiment there are four such castellations 59. A pair of radially inward projections 51 are formed on the inner surface of the ring member 49 and correspond with the radially inward indentations 53 formed in the shoulder 47. When the protective portion 60 is positioned on the closure cap 50, by applying an axial force, the projections 51 engage in the indentations 53 to prevent axial and rotational motion between the cap 50 and the protective portion 60. The combined protective portion and cap arrangement is most clearly shown in FIGS. 4 and 6. The upper surface of the ring member 49, at its internal edge, corresponds to the level of the upper surface of the cover member 52. Similarly, the outer surface of the ring member 49, at its lower edge corresponds to the outer surface of the skirt 54.

The openings 62 provided between each of the castellations 59 allow any liquid on top of the cover member 52 to drain away. Packages of sterile fluid are frequently autoclaved to ensure sterility, and it is quite possible for steam from the autoclave to condense on the packages during the cooling phase. Alternatively, water cascade autoclaves may be used, and water may collect on the packages once the sterilisation process has been completed. If the protective portion 60 did not have any openings 62 in it, it would form a cup in which any water, either condensed or collected, would be retained. It would then be necessary to invert the package 10 to remove the water or to rely on evaporation. Forming the protective portion 60 with openings 62 allows the water to simply drain out. The drainage of water can be assisted by forming the member 52 in such a manner that it is not planar, for example by having the central part of the member projecting above the peripheral region.

The lower surface of the cover member 52 is formed with a line of weakness 64 around a removable region 66. The line of weakness facilitates the removal of the region 66 in frangible manner. Removal of this region 66 exposes the upper surface of the stopper 40, which can then be punctured by a hypodermic needle or the like.

In order to allow the region 66 to be removed, a pull-ring 68 is attached to it by two legs 70 which extend from the region 66 of the cover member 52 bounded by the line of weakness 64 to one side of the pull-ring 68.

The castellations 59, projecting upwards from the ring member 49, extend above the upper surface of the cover member 52 to a height in line with, or above, the upper surface of the pull-ring 68 and the legs 70. This affords protection for the pull-ring 68 against accidental operation. Preferably, an opening 62 is provided between the castellations 59 radially opposite the legs 70 to provide a user with additionally space with which to raise the pull-ring 68 in order to hook it with the finger.

When the region 66 of the cover member 52 is removed, it leaves an opening in the cover member, exposing the stopper 40. The edges of this opening, and the edges of the portion which has been torn away, are formed from torn plastics material, and are far less sharp than similar edges formed from torn metal. The risk of a user cutting themselves on the edges, and the risk of infection associated with such cuts, is thus considerably reduced.

The package 10 can be opened in different ways. First, as described above, the pull-ring 68 can be used to remove the region 66 of the cover member 52 bounded by the line of weakness 64, by lifting and pulling the ring 68. This exposes a portion of the surface of the stopper 40, which can then be punctured by a hypodermic needle or an infusion spike or the like to gain access to the contents of the package 10. Once sufficient of the contents have been removed, the entire package 10 (comprising the bottle 20, the stopper 40 and the remainder of the cap 50) can then be discarded. As the entire package 10 is formed from plastics material, there is no need to sort the various parts for recycling or waste disposal.

Second, the cap 50 itself can be removed, followed by removal of the stopper 40. This requires the removal of the detachable ring 57 from the bottom of the skirt 54 of the cap 50, which can then be unscrewed and discarded. The stopper is removed and this allows the contents of the bottle to be poured out, or a quill or straw of e.g. an autoinjector to be inserted. Again, once the contents of the package 10 have been removed, the package 10 can be discarded without sorting.

As the protective portion 60 is formed independently of the closure cap 50 there are a number of benefits of the present package 10 over previous packages. For example, because the interconnection between the protective portion 60 and the rest of the closure cap 50 plays no part in the sealing of the upper surface of the stopper 48 there is no risk of contamination caused by an imperfect seal between separate mouldings. Additionally, because the protective portion 60 is located on the rest of the cap after its removal from the mould there is a reduced likelihood of the weakened region 64 or the pull ring 68 being damaged during the removal of the closure cap from the mould.

The protective portion 60 of this embodiment may alternatively be bonded to the closure cap 50 by an appropriate means, such as heat or ultra-sonic welding. Such a bond would prevent rotational and axial relative motion of the closure cap 50 and the protective portion 60. A benefit of bonding the protective portion 60 in place is that the openings 62 and castellations 59 provide additional means with which a user may grip the closure cap 50 to unscrew it from the container 20. Additionally, if required, a user may insert a lever means into the openings 62 to increase the rotational force applied to open the closure cap 50.

Although the above description refers to pairs of projections 51 and indentations 53, these could equally both be continuous formations along the circumference of the ring member 49 and the shoulder 47. Similarly, the location of the projections 51 and the indentations 53 on the ring member 49 and the shoulder 47 could be reversed. Alternatively, a screw thread 51 may be formed for removably attaching the protective portion 60 to the cap 50. The thread 51 may be "handed" in the same orientation as the screw thread 56 on the cap 50, or the threads 51,56 could be reverse-handed. If the screw threads 51,56 are reverse-handed the protective portion may also be used to provide additional means with which a user may grip the closure cap 50 or alternatively to allow a lever to be used to increase the rotational force applied to open the closure cap 50.

Figure 7:
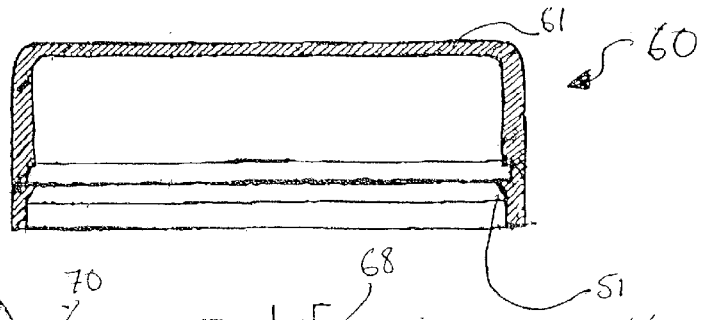
FIG. 7 is a cross-sectional view of a protective portion according to a second embodiment.
Figure 8:
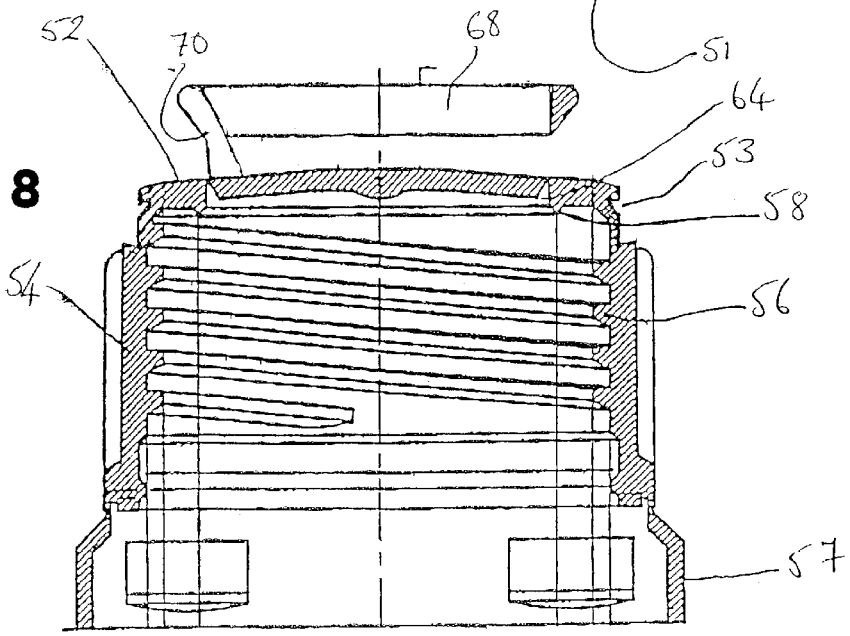
FIG. 8 is a cross-sectional view of a moulding of the cap according to a second embodiment.

A cap 50 and protective portion 60 according to a second embodiment of the invention are shown in FIGS. 7, 8 and 9. The cap is generally similar to that used in the first embodiment of the package, and corresponding features are indicated by corresponding reference numerals.

The interengagement between the protective portion 60 and the rest of the cap 50 is in the form of screw threads 51 and 53, respectively. As discussed previously, the screw threads 51 retaining the protective portion 60 may be reverse handed relative to the screw threads 56 on the cap 50 for attaching the cap 50 to the container 20.

In contrast to the first embodiment, the protective portion 60 has an upper portion 61 which covers the pull-ring 68. Thus, when the protective portion 60 is in position, the pull-ring 68 is enclosed and the likelihood of possible entanglement is reduced yet further. The outer surface of the protective portion 60 may further be provided with a series of protrusions or indentations, not shown, which make it easier for a user to grip the protective portion 60 in order to remove it. The protective portion 60 may also have a series of holes formed in its sides to allow any water which collects on top of the cover member 52, through condensation or the like, to drain off of the cap. Similarly, the upper surface of the protective portion 60 may be convex in shape to prevent water and the like collecting on top of the package 10.

The package 10 is supplied with the protective portion 60 positioned on the closure cap 50. In order to remove the removable portion 66 the user must first unscrew the protective portion 60. The removable region 66 may then be removed using the pull-ring 68, as outlined for the previous embodiment.

The protective portion 60 of the second embodiment has the advantage of providing additional protection to the removable portion 66 of the closure cap 50 right up until the time when the closure cap 50 is to be opened. Additionally, once the protective portion 60 has been removed there is additional space around the pull-ring 68 to allow a user to access the pull-ring 68 more easily. Furthermore, once the removable portion 66 and the protective portion 60 have been removed the package 10 may be used in standard autoinjectors.

Although a screw thread is suggested for attaching the protective portion 60 to the closure cap 50 any other method of removably attaching the protective portion 60 to the cap 50 would be appropriate.

It will thus be seen that in both embodiments the protective portion is formed separately from the rest of the cap and is attached thereto. The rest of the cap is a one-piece moulding, preferably made by injection moulding.

It is apparent that many modifications and variations of the invention as hereinabove set forth may be made without departing from the spirit and scope thereof. The specific embodiments described are given by way of example only, and the invention is limited only by the terms of the appended claims.

What is claimed is:

1. A cap for a container, comprising:

a moulding, the moulding comprising a retaining portion for engaging the container and retaining the cap thereon, a frangibly removable portion which is removable to expose at least partly a closure member for the container, and a user engageable member operable by a user to remove the removable portion; and a protective portion for the engageable member and provided radially outwardly thereof, the protective portion being formed separately of the moulding and being attached thereto, wherein the protective portion comprises a wall which extends generally about the periphery of the engageable member, the wall having at least one opening therethrough.

2. The cap as claimed of claim 1, wherein the protective portion is removably attached to the moulding.

3. The cap of claim 1, wherein said opening is sufficiently large to allow radial access by a user's finger to the engageable member.

4. The cap of claim 3, wherein the opening allowing such radial access is located opposite to a portion of the moulding which connects the engageable member and the removable portion.

5. The cap of claim 1, further comprising a tamper-evident member that is removably attached to the cap.

6. The cap of claim 5, wherein said tamper-evident member is a ring which engages beneath the lip of the container.

7. A cap for a container, comprising:

a moulding, the moulding comprising a retaining portion for engaging the container and retaining the cap thereon, a frangibly removable portion which is removable to expose at least partly a closure member for the container, and a user engageable member operable by a user to remove the removable portion; and a protective portion for the engageable member and provided radially outwardly thereof, the protective portion being formed separately of the moulding and being attached thereto, wherein the removable portion has an inclined surface to assist drainage thereof when the cap is in an upright position.

8. The cap of claim 1, wherein the protective portion is in the form of a removable cover over the engageable member.

* * * * *